United States Patent [19]

Gainer et al.

[11] 4,159,255

[45] Jun. 26, 1979

[54] MODIFIED CASTOR OIL LUBRICANT FOR REFRIGERATOR SYSTEMS EMPLOYING HALOCARBON REFRIGERANTS

[75] Inventors: Gordon C. Gainer, Penn Hills; Russell M. Luck, Monroeville, both of Pa.

[73] Assignee: Westinghouse Electric Corp., Pittsburgh, Pa.

[21] Appl. No.: 789,907

[22] Filed: Apr. 22, 1977

[51] Int. Cl.[2] ..... C10M 5/12

[52] U.S. Cl. ..... 252/52 R; 252/56 R

[58] Field of Search ..... 252/52 R, 56 R

[56] References Cited

U.S. PATENT DOCUMENTS

| | | | |
|---|---|---|---|
| 2,807,155 | 9/1957 | Williamitis | 52/112.7 |
| 2,922,764 | 1/1960 | Boswell et al. | 252/52 X |
| 3,704,277 | 11/1972 | Clark | 252/52 X |
| 3,715,302 | 2/1973 | Mills et al. | 208/14 |
| 3,878,112 | 4/1975 | Luck et al. | 252/56 X |

*Primary Examiner*—Robert V. Hines
*Attorney, Agent, or Firm*—D. P. Cillo

[57] ABSTRACT

A centrifugal compressor refrigeration system is made, employing a halocarbon gas refrigerant in contact with a lubricant composition comprising 100 parts of castor oil and from 20 parts to 110 parts of a chemically and thermally stable, low viscosity blending fluid, soluble in castor oil; wherein the halocarbon gas is only slightly soluble in the lubricant composition, which provides good lubricity over the expected temperatures and operating conditions of the refrigeration system and is highly resistant to chemical reaction with the halocarbon and/or materials in the refrigeration system.

8 Claims, 3 Drawing Figures

MODIFIED CASTOR OIL LUBRICANT FOR REFRIGERATOR SYSTEMS EMPLOYING HALOCARBON REFRIGERANTS

BACKGROUND OF THE INVENTION

The present invention relates to novel, modified castor oil lubricating compositions for use in centrifugal compressor refrigerant systems and, in particular, to lubricating compositions having high lubricity which are thermally and chemically stable in the presence of and in contact with partially or completely fluorinated halocarbon gas refrigerants, said refrigerants being only slightly soluble in the lubricating compositions. The term halocarbon is herein used to mean hydrocarbon compounds having fluorine and chlorine atoms substituted for a high proportion or all of the monovalent hydrogen atoms on the carbons.

Refrigerant systems utilizing halocarbon refrigerants, such as dichlorodifluoromethane require specialized lubricants. These lubricants must be resistant to thermal and chemical decomposition at high temperatures present during gas compression, in the presence of the halocarbons.

In providing air conditioning for office buildings, stores, apartments and motels, for example, it is desirable and important to provide quiet, low vibration compressors that are compact and occupy the smallest possible space for the power needed to provide the requisite heat removal under expected conditions. Many of these air conditioning units employ chilled water, produced by the heat exchanger associated with the compressor, to effect suitable conditioning of the air in the building.

Piston type units are not only relatively large for a given horsepower, but they are noisy and vibrate. Centrifugal compressors driven by, for example, 50 to 600 horsepower electric motors have been found to be much more compact, so that they occupy only a fraction of the space required for a piston type unit of the same horsepower. Furthermore, considering the horsepower, the high speeds of up to 36,000 rpm of the centrifugal compressor, and large volumes of refrigerant handled per unit time, the compressor units are extremely quiet and are characterized by very little vibration.

However, a serious problem has been encountered in the starting of centrifugal compressors. The start-up of a centrifugal unit from a cold condition, normally 15° C. to 24° C., to a fully operational condition has often taken several hours. Under all conditions, a separate oil pump unit is first set in operation to deliver a flow of lubricating oil to the bearings, gears and oil-operated control mechanism; and only after an adequate flow of lubricant has been established, is the centrifugal compressor put into operation. Initial high thrust loads are encountered in the impeller bearings requiring good lubricant films to be present at all times when in operation.

This prolonged delay in a cold start occurs because of the high solubility of the halocarbon refrigerant, usually refrigerant 12, dichlorodifluoromethane, hereinafter referred to as R-12, in any of the otherwise satisfactory lubricating petroleum base oils used for lubricating the bearings and gearing of the centrifugal compressor. The halocarbon refrigerant comes into contact with the lubricant in the normal operation of the centrifugal compressor.

Large volumes of halocarbon gas dissolve in cold oil because the solubility of the halocarbon gas increases as temperature drops, and when the oil is being pumped to the compressor rotor and bearings, the dissolved halocarbon refrigerant readily boils out as a gas as a result of even small changes in pressure or temperature. Frequently, the oil or lubricant is flushed from the bearings during shutdown so that the bearing is dry and presents a highly undesirable dry metal to dry metal contact condition at the time start-up is required.

On a cold start-up, oil in the oil sump is saturated with halocarbon, which drastically dilutes the oil, and which halocarbon boils out of the oil lubricant to produce large volumes of foam both in the sump and in the oil lines, as well as in the bearings and at other places in the oil circuit when the oil pump is set into operation to convey oil or lubricant to the bearings, gears, and elsewhere. Unless the oil is still hot from previous use, insufficient oil will flow to the bearings, and at most, an initial halocarbon-oil foam is present which is inadequate to accomplish effective lubrication.

Failure of the bearings will occur if the compressor motor is started under these poor lubricating conditions. Further, the viscosity of the oil is reduced seriously by the dissolved halocarbon, so that the lubrication properties of the oil are deleteriously modified by this unwanted dilution. This is in addition to the danger that a sudden release of gas in the oil film on the bearing surfaces will cause a partial oil film failure which permits bare metal to bare metal contact with the potential for bearing damage.

At the present time, one involved procedure to mitigate this lubrication problem, in centrifugal compressors, is to provide a heater in or about the oil sump—so that the oil will be heated up to and maintained at, for instance, 65° C. to minimize the amount of the halocarbon refrigerant, such as R-12, in solution in the oil.

In order to avoid the continual use of the heaters for lengthy shutdown periods, at start-up the oil sump is initially heated for several hours (using for instance 5 KW heaters) in order to drive out as much halocarbon from the progressively heated oil as is reasonably possible before actual operation of the oil pump of the compressor. The oil pump is then energized to pump the hot oil with low halocarbon content through the oil lines and into the bearings.

The chemical stability of the lubricants for a centrifugal refrigeration compressor is an important factor, since the systems are hermetically sealed and any reactions with the halocarbon refrigerant which cause deterioration of the lubricant so that it decomposes, and fails to provide adequate lubrication or reacts to form solids which will plug up tubing and orifices, as well as lead to its failure to function effectively as a lubricant, is fatal to the compressor system. Metals such as iron, aluminum and copper used in compressors are commonly in contact with the lubricant, and the halocarbon, of course, dissolves in the lubricant. This combination of materials at elevated temperatures can react adversely to cause the oil to ultimately fail.

The overall lubrication and start-up procedure would be greatly simplified by the existence of a lubricant which had a low affinity for halocarbon refrigerants, such as R-12, i.e., a lubricant in which R-12 is relatively insoluble, or as a minimum, in which R-12 or other halocarbon is slowly dissolved. Such a lubricant, as pointed out above, would permit much more rapid and reliable cold start up, and would be an improvement over known materials if it would also retain chemical and thermal stability in the presence of R-12.

Williamitis, in U.S. Pat. No. 2,807,155, recognized problems of thermal stability of lubricant systems in contact with a chlorodifluoromethane refrigerant, in refrigeration apparatus. He used pentaerythritol esters, dipentaerythritol esters, and tripentaerythritol esters which were highly soluble in the refrigerant, and had viscosities of up to 2,000 SUS, as the sole chemical and thermally stable lubricant. Mills et al., in U.S. Pat. No. 3,715,302, achieved outstanding chemical and thermal lubricant stability, in an R-12 refrigerant environment, by using a blend of hydrorefined naphthenic oil and refined and dewaxed paraffinic oil. This blend had a viscosity of up to 500 SUS at 100° F., and was miscible in fluorinated hydrocarbon refrigerants such as R-12. Luck and Gainer, in U.S. Pat. No. 3,878,112, solved refrigerant solubility problems by using glycol diricinoleates as synthetic lubricants for centrifugal refrigeration compressors. These materials have a low solubility for fluorocarbon refrigerants but they are expensive and difficult to make in a highly pure state.

SUMMARY OF THE INVENTION

The present invention comprises a halocarbon refrigeration system, employing new, improved, and inexpensive lubricants, which overcomes the above described problems. A lubricant composition is provided which is a mixture of high viscosity and low viscosity fluids, which in combination have a low affinity for R-12, and yet provide excellent chemical and thermal stability in a refrigeration environment. This lubricating composition blend minimizes parasitic losses during refrigeration running, by minimizing the amount of R-12 dissolved in the lubricating blend, and therefore lost to the chilling function of the system.

The lubricating composition comprises a mixture of (1) 100 parts of chemically and thermally stable castor oil and (2) a low viscosity blending fluid additive, having a viscosity of up to 335 SUS at 100° F., which is soluble in castor oil, and chemically and thermally stable in the presence of halocarbon refrigerants. The blending fluid is selected from pentaerythritol esters of saturated fatty acids, dipentaerythritol esters of saturated fatty acids, alkylated diphenyl esters, neopentyl esters, and their mixtures.

Castor oil has a very high viscosity, approximately 1,555 SUS at 100° F., making it completely unsuitable as a compressor lubricant. Castor oil, however, is relatively inexpensive and has extremely low affinity for R-12. The low viscosity blending fluids described above, when added to castor oil, can reduce the mixture viscosity to about 600 SUS at 100° F., which is suitable for use in centrifugal compressors. While the low viscosity fluids are themselves relatively soluble in R-12, the mixture of them with castor oil exhibits a very low affinity for R-12, good lubricating qualities, low wear rates, and chemical and thermal stability in the presence of R-12. In addition, and very importantly, the additives are inexpensive and commercially available.

BRIEF DESCRIPTION OF THE DRAWING

For a better understanding of the invention, reference may be made to the drawings, in which.

DESCRIPTION OF THE PREFERRED EMBODIMENTS

Figure 1:
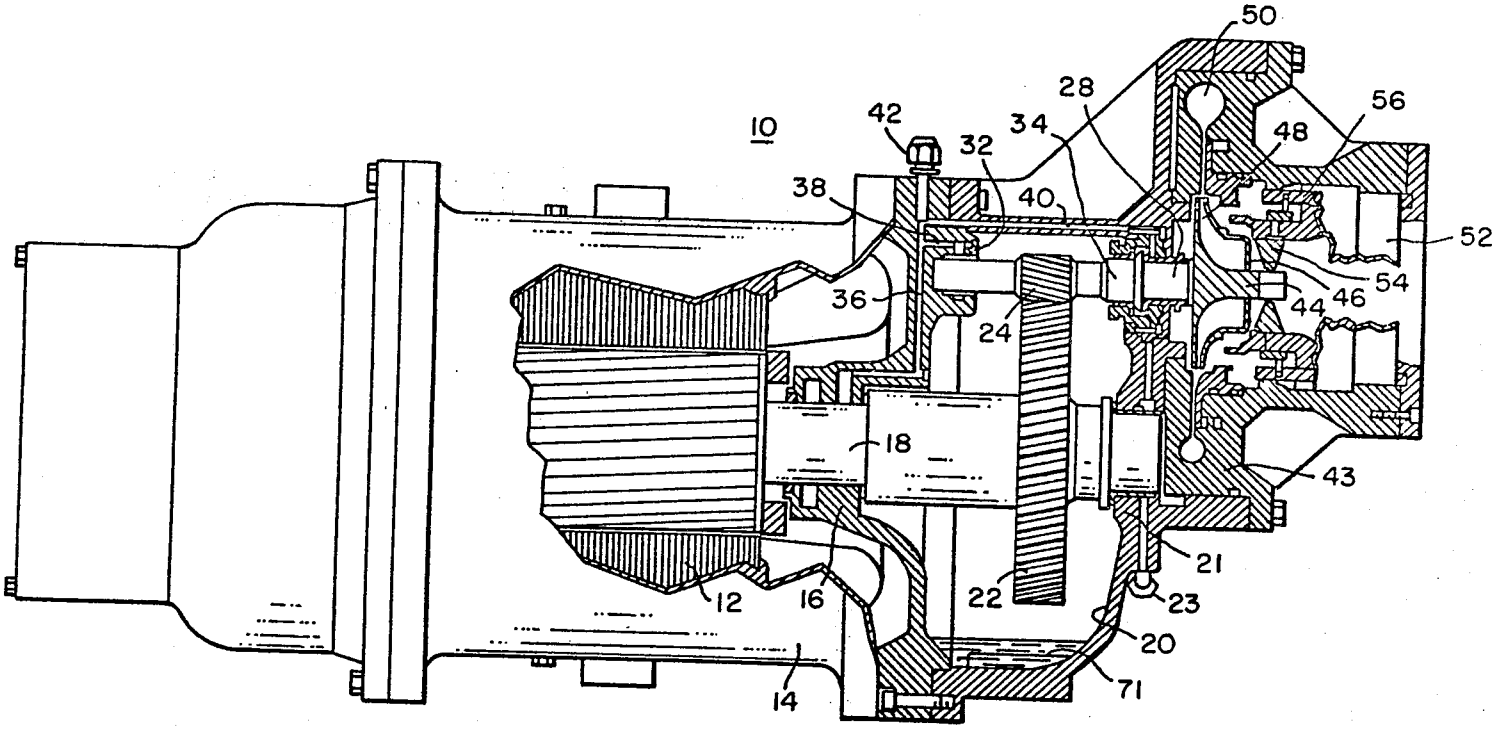
FIG. 1 is a vertical cross-section through a portion of one type of a centrifugal refrigeration compressor.

Referring to FIG. 1 of the drawings, there is shown a vertical cross-section through a portion of a typical centrifugal refrigeration compressor 10. The refrigeration compressor comprises a motor 12, for example from 50 to 600 horsepower, within a casing 14. The casing 14 includes bearings in which is mounted a motor drive shaft 18 extending through a bearing 16 into a gear compartment 20, with the right-hand end of the shaft being supported in a bearing 21. The portion of the shaft 18 in gear compartment 20 is provided with a large driven helical spur gear 22 driving a smaller gear 24 affixed to a centrifugal impeller shaft 28. The ratio of the diameters of gears 24 and 22 is of the order of 10:1 so that when motor 12 is operating at 1,800 rpm, the compressor shaft will be rotating at a speed of 18,000 rpm, while a 3,600 rpm motor may drive the compressor at from 32,000 to 36,000 rpm. The ends of centrifugal impeller shaft 28 are mounted in bearings 32 and 34.

Lubricant is supplied to the bearings 16, 32, 34 through channels 36, 38 and 40 from a main lubricant manifold 42. Bearing 21 is lubricated by a lubricant manifold 23. Because of the high speeds and high power being transmitted to the impeller, it is mandatory that a large volume of lubricant be supplied to the bearings at all times during the operation of the compressor. An oil or lubricant mist escapes from bearings 16, 21, 32 and 34 by reason of shaft clearances into the gearing casing 20, the high speed of the shaft 28 in particular throwing out the oil as a mist which impinges on and lubricates the gear teeth of gears 22 and 24.

Upon the extreme right-hand end of the shaft 28 is mounted a centrifugal compressor impeller 44 having an inlet end 46 adjacent the right-hand end of the shaft hub and an exit portion 48 at which hot compressed refrigerant gases are expelled under pressure into a refrigerant gas manifold 50 from where they flow to a suitable condenser (not shown). Refrigerant gas enters through a relatively large gas inlet conduit 52 at the extreme right-hand end of the compressor, as shown in FIG. 1. Admission of the halocarbon gas in conduit 52 to the inlet end 46 of the compressor is controlled by a series of circumferentially positioned inlet vanes 54 pivotally mounted in the conduit 52 in front of the inlet end of the centrifugal impeller. The vanes 54 are rotated to a desired gas flow control position by a piston member 56 having portions affixed to eccentrically placed pins on the vanes 54, which piston member moves in response to admission of lubricant under pressure to one or the other end thereof in response to amounts of refrigerant needed as determined by a vane control sensor mechanism (not shown) to move the vanes 54 to any position between fully open and a substantially closed position. Consequently, flow of halocarbon refrigerant gas to the centrifugal impeller is controlled by this vane and piston mechanism.

In order to secure a high output from the electrical motor 12, it is a common practice to spray condensed, liquid halocarbon refrigerant on the motor windings in order to absorb heat therefrom so that the motor will be cooled adequately to a safe operating temperature when high electrical power input is applied thereto. Because of this enhanced cooling, an extremely small, in physical size, motor can be employed to deliver the necessary horsepower to the centrifugal compressor proper.

Figure 2:
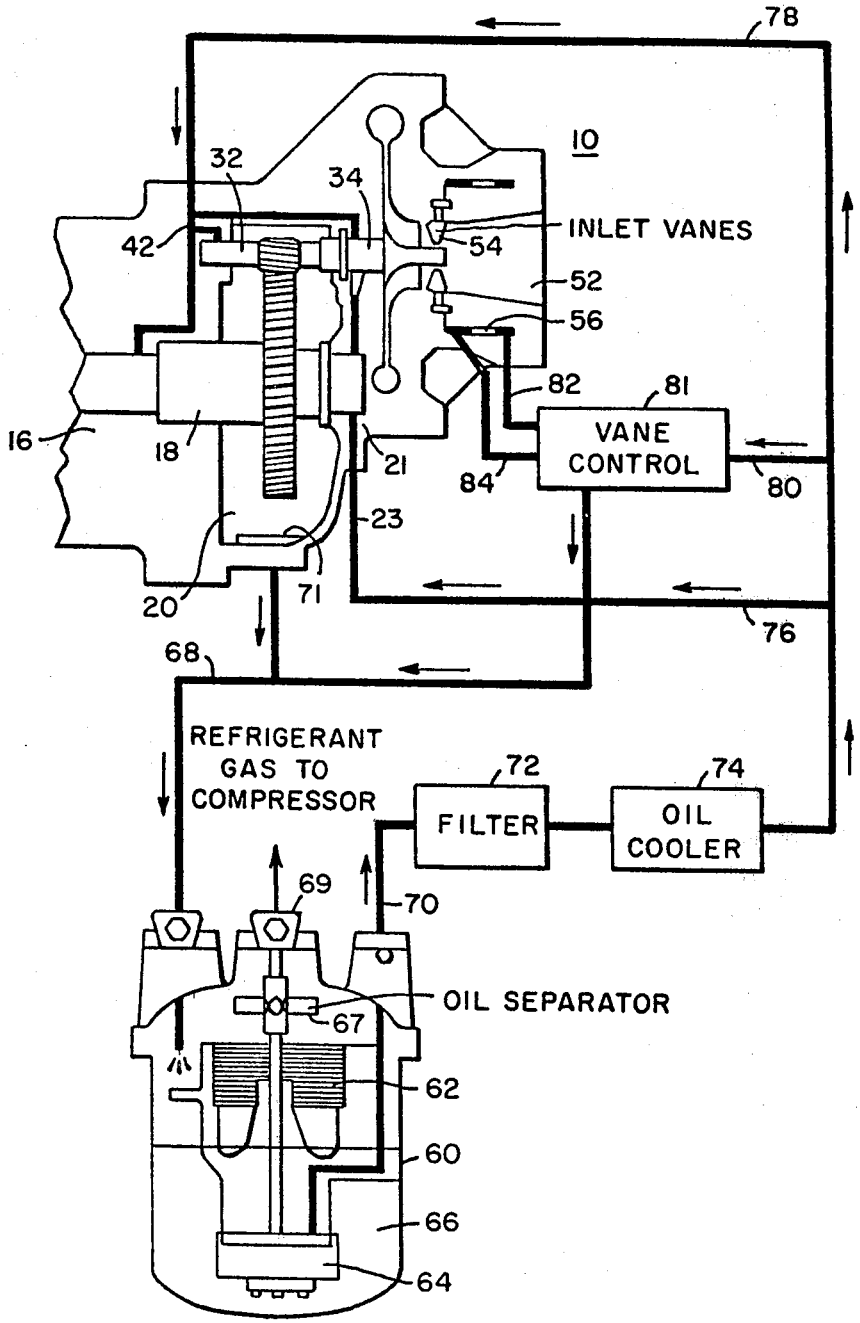
FIG. 2 is a schematic diagram with portions in cross-section of a centrifugal refrigeration compressor.

Referring to FIG. 2 of the drawings, there is illustrated schematically the distribution of lubricant to the centrifugal refrigeration compressor of FIG. 1. An enclosed oil sump and pump unit 60 encloses a motor 62 operating a pump 64 disposed within the lower portion thereof where it is immersed within a reservoir of lubricant 66 which will ordinarily be present at some level therein at all times. Lubricant escaping from the bearings, gears casing, and the vane control system enters by way of a conduit 68 into the sump 60. The oil returning to the sump conduit 68 has been exposed to and has dissolved therein halocarbon refrigerant. The amount of dissolved halocarbon refrigerant, for example R-12, is related to the gas pressure and the temperature of the oil.

When the pump 64 is energized, oil under pressure is conveyed through a pipe 70, passing first through a filter 72 to remove any solid particles therefrom and then through an oil cooler 74 to reduce the temperature of the oil. The cooled oil then is conveyed by a pipe 76 to manifold 23 and thence to the right-hand end bearing 21, supporting motor shaft 18, and also through a pipe 78 to the oil manifold 42 from where an abundant flow of oil is directed to the bearings 16, 32 and 34. In addition, oil is conveyed through conduit 80 to a vane control mechanism 81 operated by a suitable sensor (not shown), which feeds requisite amounts of oil through lines 82 and 84 to the vane control piston 56.

It has been found that if the oil in sump 60 is relatively cold and contains large amounts of dissolved halocarbon gas such as R-12, upon operation of the pump 64 and when the impeller 44 is started, the pressure in the sump will drop and immediately a large amount of oil halocarbon foam will be produced in the sump. Furthermore, as the cold oil still with substantial amounts of halocarbon dissolved therein passes into pipe 70, more halocarbon gas will evolve and the pipe, filter 72 and the oil cooler 74 will be filled with a foam. Some of the foam will pass through the oil separator where the oil is centrifugally spun off, and oil free halocarbon gas fows from connection 69 via a conduit to inlet 52 of FIG. 1.

When a highly foamed oil containing substantial amounts of dissolved halocarbon is directed to the bearings, both its quantity and viscosity will have been reduced by reason of the foaming and the presence of the large volume of halocarbon liquid components therein so that the bearings will not have a sufficient amount of oil of a proper viscosity and load bearing film forming properties on the surface in a condition to provide effective lubrication. If the centrifugal compressor motor 12 were to be caused to operate under such conditions, bare metal to bare metal contact of the bearing surfaces is liable to occur, with excessive and rapid wear of the bearings taking place which could lead to catastrophic premature failure. Oil escaping from the shaft bearings enters gear casing 20 where it collects and absorbs more halocarbon gas and reenters oil drain line 68 and thus goes back to the sump 60.

The oil used as the base of the new and improved lubricating composition of this invention is castor oil, i.e., glycerol triricinoleate. Castor oil has good lubricating properties because it is a triester containing three hydroxyl groups per molecule, having a large molecular weight. Alone, however, castor oil is not a useful lubricant for commercial centrifugal industrial air conditioning compressors, because of its very high viscosity, approximately 1,555 SUS at 100° F., and because of its undesirably high pour point, approximately minus 10° F. Air conditioning centrifugal compressors are generally designed to operate on refrigeration oils having viscosities below about 700 SUS at 100° F., such as Suniso 4GS, and in larger machines Suniso 5GS (both sold by Sun Oil Co.). These are highly refined petroleum products having viscosities at 100° F. of 285 SUS and 500 SUS, respectively.

Castor oil, however, is an excellent lubricant, displays good extreme pressure seizure values, exhibits an outstanding low affinity for halocarbon refrigerants, such as R-12, exhibits good high chemical and thermal stability toward halocarbon refrigerants, such as R-12, and it is low in cost.

A key feature of the invention is that the fluid additive used with the castor oil must be miscible with castor oil in an amount effective to lower the viscosity of the blend to below about 700 SUS at 100° F., and must remain soluble in the castor oil to the lowest anticipated operating temperatures involving air conditioning centrifugal chillers. The blending fluid must also be resistant to long-term thermal aging in the presence of halocarbon refrigerants, such as R-12, must exhibit relatively low affinity for halocarbon refrigerants, must exhibit good lubricating qualities, a wide liquid range, low volatility, low coefficient of friction, noncorrosiveness to metal combinations under high mechanical loads, low wear rates and it must be readily available and low in cost.

Few materials provide all these qualities, particularly solubility in castor oil. Mineral oil based refrigeration oils, such as Suniso 4GS and 5GS cannot be used because they are essentially insoluble in castor oil. Alkyl benzenes were found to be similarly too low in solubility in castor oil to be considered. Alkylated diphenyl ethers having from 4 to 24 carbons attached to one of the phenyl groups have been found useful, particularly dodecyl diphenyl ether, having a viscosity of about 300 SUS to 330 SUS at 100° F. Other useful blending fluids include neopentyl esters, having a viscosity of about 125 SUS to 175 SUS at 100° F. The preferred low viscosity blending fluids are pentaerythritol esters and dipentaerythritol esters, having viscosities at 100° F. of about 75 SUS to about 320 SUS. These esters are produced from pentaerythritol and normal or branched chain saturated fatty acids such as octanoic acid, 2 ethylhexanoic acid and the like. For example, the additive may include esterified monomolecular pentaerythritol and dipentaerythritol:

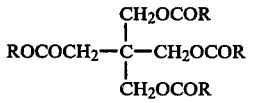

and

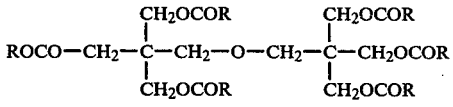

where R represents a saturated aliphatic straight or branched hydrocarbon chain having from 8 to 18 carbon atoms. These materials with a central carbon atom surrounded by four others have excellent oxidative stability.

The saturated fatty acids are derived indirectly from natural fats and oils, such as tallow and olive oil. The pentaerythritol compounds may be produced by reacting acetaldehyde with formaldehyde in an alkaline medium. The esters may be formed by reacting the pentaerythritol compounds with saturated organic fatty acids having the hydrocarbon structure described by R above. The acids used are those having no reactive groups other than the carboxyl. The R group mentioned above may each be a different radical selected from the classes described above. These blending fluids may be used alone to blend with the castor oil or used in mixtures to blend with the castor oil. The maximum viscosity of the blending fluid is 335 SUS with a preferred range of about 50 SUS to 300 SUS at 100° F. Use of blending fluids to dilute the castor oil having viscosities over 335 SUS will require excessive addition to the castor oil with resulting high R-12 absorption values.

The weight ratio of castor oil:blending fluid must be within the range of 100:20 to 100:110. Use of under 20 parts blending fluid per 100 parts castor oil results in a blend having viscosities over about 700 SUS at 100° F., making it unsuitable for use in centrifugal compressors. Over 110 parts blending fluid per 100 parts castor oil, the blend has increased affinity for halocarbon refrigerants, resulting in poor cold start-up and decreased reliability of the system.

When the blending fluids are used with the castor oil, within the viscosity and weight ranges set forth above, in a centrifugal compressor refrigeration system in contact with halocarbon refrigerant, the lubricant composition will have a viscosity of below about 700 SUS at 100° F. It will provide for good lubricity over the expected temperatures and operating conditions of the refrigeration system while being highly resistant to chemical reaction with the halocarbon and/or other materials used in the refrigeration system.

To better understand the nature and advantages of the present invention, numerous comparative tests, described below, have been made directed to determine the thermal stability, lubricity, and halocarbon absorption of the lubricating compositions of this invention.

With regard to thermal and chemical stability, the standard "sealed tube test" has been utilized. This test is described in detail by H. Elsey in "Small Sealed Tube Procedure for Quality Control of Refrigeration Oils", 71 ASHRAE Transactions, Pt. 1, p. 143 (1965). Generally, this test involves introducing equal amounts of oil and R-12 refrigerant and samples of the compressor metals employed with which the lubricant and refrigerant come in contact, into a clean, dry glass tube which is sealed and, in our work, heated to 125° C. and held for a long period of time. These tubes are visually inspected for changes in color and appearance of the metals and deposits.

The standard Falex seizure test was performed on selected lubricant samples. This test gives data on the lubricating ability of the lubricants in terms of maximum load carrying ability to the point of failure. In addition, lubricating ability was also determined by testing on the Falex Tester. See, "Falex Lubricant Testing Machine" Instruction Manual issued by Faville-Le Valley Corp., 1129 Bellwood Avenue, Bellwood, Ill., Generally, the Falex wear test is made by applying a known load to two self-aligning V-blocks that squeeze a small rotating shaft. In testing, a new test piece is broken in at about 50 psig. (gauge) for 10 minutes followed by a 200 psig. (gauge) run for 5 minutes. A load of 250 psig. (gauge) is applied for the duration of the test which is approximately 4 hours. A 250 psig. (gauge) corresponds to about 15,000 psi to 20,000 psi on the projected wear area and represents a very severe test for boundary lubricating ability. Any wear which occurs on the test pieces is reflected by a drop in the applied load as indicated on the gauge. Thus, every fifteen minutes the gauge is readjusted to 250 pounds and the take-up is recorded on a calibrated wheel as wear units. The wear in the following table is expressed as "wear units per hour" and represents the total number of units recorded over a four-hour period divided by four.

Figure 3:
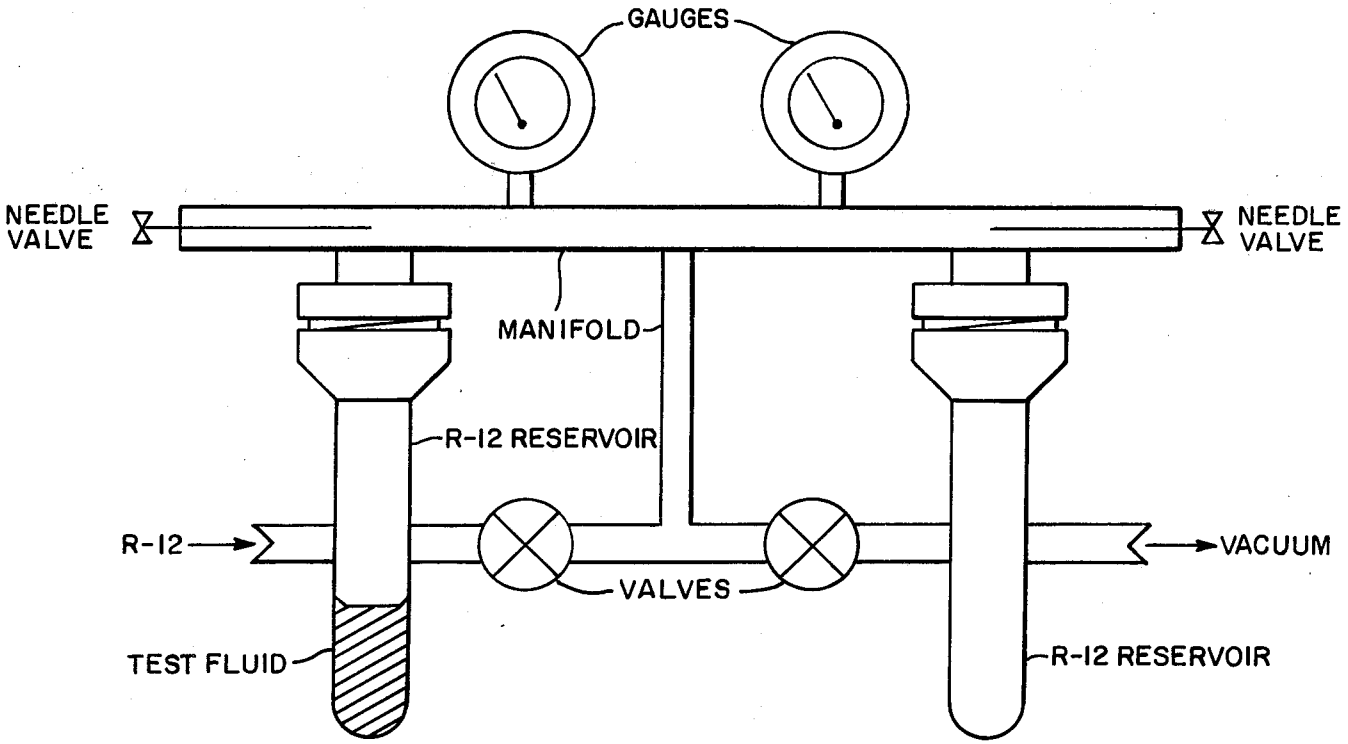
FIG. 3 is a drawing showing the test apparatus used in the Example to determine wt.% R-12 solubility in the lubricating composition.

Halocarbon gas affinity was evaluated by noting pressure drop as a function of time when the blended oil was exposed to an initial pressure of 55 psig. (gauge) i.e., 70 psia. in contact with R-12 in a closed system, at 25° C. The test apparatus is shown in FIG. 3 of the drawings. Three cubic centimeters of the test sample was placed in a glass tube connected to a manifold. The system was evacuated for 5 minutes to 0.5 Torr. The evacuated system was then isolated from the vacuum pump, and R-12 gas rapidly introduced to the system from a tank to an initial pressure of 55 psig. The system was then sealed off. The empty tube, manifold and upper section of the other tube containing the test fluid serves as the R-12 reservoir, which was measured to have a volume of 32.5 cubic centimeters. Total system volume equals 35.5 cubic centimeters. As the R-12 dissolves in the blended test oil, the pressure of the system decreases. The system pressure is recorded periodically as a function of time for a three-hour period. The lubricating compositions of this invention should have a low affinity for halocarbon gas. The halocarbon gas should be only slightly soluble in the lubricant, i.e., between about 1 weight percent to about 8 weight percent, when a 3 cubic centimeter sample is contacted with dichlorodifluoromethane gas at an initial pressure of 55 psig. (gauge) and 25° C. after 3 hours contact, the gas contained in a 32.5 cubic centimeter gas reservoir.

EXAMPLE 1

A number of castor oil-additive blends were mixed and tested, along with comparative samples of castor oil, Suniso 4GS, and the pentaerythritol ester of a fatty acid used alone in contact with dichlorodifluoromethane gas (R-12). The results of the tests are shown in Tables 1, 2 and 3 below:

TABLE 1

| | | R-12 ABSORPTION AT 25° C. | | | | |
|---|---|---|---|---|---|---|
| | | | R-12 Pressure (lb/sq.in. gauge) | | | R-12 Solubility (% by wt.) |
| Sample | Composition (parts by weight) | Viscosity (100° F.) | initial | 3 hrs. | change | 3 hrs. |
| 1 | 100p castor oil 100p dodecyl diphenyl ether | 520 SUS | 55 | 39 | 16 | 7.5 |
| 2 | 100p castor oil 60p dipentaery- | 660 SUS | 55 | 42 | 13 | 5.8 |

TABLE 1-continued

| Sample | Composition (parts by weight) | Viscosity (100° F.) | R-12 ABSORPTION AT 25° C. R-12 Pressure (lb/sq.in. gauge) initial | 3 hrs. | change | R-12 Solubility (% by wt.) 3 hrs. |
|---|---|---|---|---|---|---|
| | thritol ester of a fatty acid | | | | | |
| 3 | 100p castor oil 53p pentaerythritol ester of a fatty acid | 510 SUS | 55 | 42.5 | 12.5 | 5.8 |
| 4 | 100p castor oil 40p pentaerythritol ester of a fatty acid | 620 SUS | 55 | 44.5 | 10.5 | 5 |
| 5 | 100p castor oil 33p pentaerythritol ester of a fatty acid | 620 SUS | 55 | 44 | 11 | 5 |
| 6 | 100p castor oil | 1555 SUS | 55 | 49 | 6 | 3 |
| 7 | 100p pentaerythritol ester of a fatty acid | 120 SUS | 55 | 27.2 | 27.8 | 15 |
| 8 | 100p Suniso 4GS | 285 SUS | 57 | 34 | 23 | 9.5 |

The castor oil used was Baker "DB" grade; the pentaerythritol and dipentathaerythritol esters were esters of saturated fatty acids having from about 8 to 18 carbons, the viscosity of the esters used ranged from about 85 SUS to about 265 SUS at 100° F. (sold commercially by Emery Industries under the tradename Emolein 2939A, and Ester C and Ester F from William F. Nye Inc.). As can be seen from Table 1, castor oil alone has outstandingly low R-12 absorption, but a prohibitatively high viscosity. Pentaerythritol ester of a fatty acid alone has good viscosity properties but relatively high R-12 absorption. Blends of from 33 parts to 100 parts of selected blending fluid per 100 parts of castor oil gave a combination of low viscosity and low R-12 absorption.

TABLE 2

| Sample | THERMAL STABILITY TO R-12 SEALED TUBE TEST AT 125° C. Weeks to Failure |
|---|---|
| 1 | 20+ weeks - slightly better than Suniso 4GS |
| 2 | 20 weeks - equivalent to Suniso 4GS |
| 3 | 20+ weeks - better than Suniso 4GS |
| 4 | 20+ weeks - better than Suniso 4GS |
| 5 | 20+ weeks - much better than Suniso 4GS |
| 6 | 20+ weeks - better than Suniso 4GS |
| 7 | 20+ weeks - much better than Suniso 4GS |
| 8** | at 20 weeks - copper plating |

*All tubes contained aluminum, copper, cast iron and reed steel
*Suniso 4GS

These tests showed that all of the materials possessed very good chemical and thermal stability in the presence of R-12.

TABLE 3

| Sample | FALEX LUBRICATION TEST 250 lb/sq.in. gauge, 1137 SAE Block, 3135 SAE Pin Wear | FALEX SEIZURE TEST EP Seizure* |
|---|---|---|
| 3 | 4 units per hour | 1,650 pounds |
| 4 | 6 units per hour | 1,650 pounds |
| 6 | 2 units per hour | 1,600 pounds |
| 8 | 9 units per hour | 1,000 pounds |

*Gauge pressure at seizure.

As can be seen from Sample 6, castor oil has excellent, low wear values, exhibiting outstanding lubricity, and blends 3 and 4 have low wear and excellent seizure values, exhibiting good to very good lubricity.

Sample 3 has been used successfully for over 6 months as a lubrication fluid in large, 550-ton centrifugal, water-cooled, air conditioning water chillers, operating with R-12 refrigerant. Samples containing the alkylated diphenyl ethers and neopentyl esters, as hereinabove described, would be equally good blending fluids for the castor oil base.

We claim:

1. In a centrifugal refrigeration compressor system employing a halocarbon refrigerant, in combination, a lubricant composition in contact with the halocarbon refrigerant and having chemical and thermal stability in the presence of the halocarbon refrigerant, the lubricant composition consisting essentially of:

(A) 100 parts of a chemically and thermally stable castor oil, and (B) from about 20 parts to about 110 parts of a chemically and thermally stable, low viscosity blending fluid, having a viscosity of up to 335 SUS at 100° F. and being soluble in castor oil, selected from the group consisting of alkylated diphenyl ethers, neopentyl esters, pentaerythritol esters of saturated fatty acids, dipentaerythritol esters of saturated fatty acids, and mixtures thereof; wherein the halocarbon is only slightly soluble in the lubricant composition, and wherein the lubricant composition has a viscosity of up to 700 SUS at 100° F., provides for good lubricity over the expected temperatures and operating conditions of the refrigeration system and is highly resistant to chemical reaction with the halocarbon and/or materials in the refrigeration system.

2. The system of claim 1, wherein dichlorodifluoromethane gas, in contact with the lubricant composition, is soluble in 3 cubic centimeters of the lubricant composition in the range of between about 1 weight percent to about 8 weight percent at an initial pressure of 55 psig. at 25° C. after 3 hours contact, the gas being contained in a 32.5 cubic centimeter gas reservoir.

3. The system of claim 1, wherein the halocarbon is dichlorodifluoromethane.

4. The system of claim 1, wherein the blending fluid has a viscosity of between about 50 SUS to 300 SUS at 100° F.

5. The system of claim 1, wherein the alkylated diphenyl ether additive is dodecyl diphenyl ether.

6. The system of claim 1, wherein the blending fluid is selected from the group consisting of alkylated diphenyl ethers having 4 to 24 carbons attached to one of the phenyl groups, neopentyl esters, pentaerythritol esters of saturated fatty acids having from 8 to 18 carbon atoms, dipentaerythritol esters of saturated fatty acids having from 8 to 18 carbon atoms, and mixtures thereof.

7. In a centrifugal refrigeration compressor system employing a halocarbon refrigerant, in combination, a lubricant composition in contact with the halocarbon refrigerant and having chemical and thermal stability in the presence of the halocarbon refrigerant, the lubricant composition consisting of:

(A) 100 parts of a chemically and thermally stable castor oil, and (B) from about 20 parts to about 110 parts of a chemically and thermally stable, low viscosity blending fluid, having a viscosity of up to 335 SUS at 100° F. and being soluble in castor oil, selected from the group consisting of neopentyl esters, pentaerythritol esters of saturated fatty acids, dipentaerythritol esters of saturated fatty acids, and mixtures thereof; wherein the halocarbon is only slightly soluble in the lubricant composition, and wherein the lubricant composition has a viscosity of up to 700 SUS at 100° F., provides for good lubricity over the expected temperatures and operating conditions of the refrigeration system and is highly resistant to chemical reaction with the halocarbon and/or materials in the refrigeration system.

8. The system of claim 7, wherein the halocarbon is dichlorodifluoromethane.

* * * * *